US011779926B2

(12) United States Patent
Foley et al.

(10) Patent No.: US 11,779,926 B2
(45) Date of Patent: Oct. 10, 2023

(54) DIGITAL FLUIDIC CARTRIDGE WITH INLET GAP HEIGHT LARGER THAN OUTLET GAP HEIGHT

(71) Applicant: ILLUMINA, INC., San Diego, CA (US)

(72) Inventors: Jennifer Olivia Foley, San Diego, CA (US); Darren Segale, San Diego, CA (US); Cyril Delattre, San Diego, CA (US)

(73) Assignee: ILLUMINA, INC., San Diego, CA (US)

( * ) Notice: Subject to any disclaimer, the term of this patent is extended or adjusted under 35 U.S.C. 154(b) by 709 days.

(21) Appl. No.: 16/616,860

(22) PCT Filed: Nov. 9, 2018

(86) PCT No.: PCT/US2018/060153

§ 371 (c)(1),
(2) Date: Nov. 25, 2019

(87) PCT Pub. No.: WO2019/099304

PCT Pub. Date: May 23, 2019

(65) Prior Publication Data

US 2020/0391212 A1 Dec. 17, 2020

Related U.S. Application Data

(60) Provisional application No. 62/585,726, filed on Nov. 14, 2017.

(51) Int. Cl.
*B01L 3/00* (2006.01)

(52) U.S. Cl.
CPC ..... *B01L 3/502792* (2013.01); *B01L 3/50273* (2013.01); *B01L 2300/0645* (2013.01);
(Continued)

(58) Field of Classification Search
CPC ..... B01L 3/502792; B01L 3/50273; B01L 2300/0645; B01L 2300/0851; B01L 2400/0427
See application file for complete search history.

(56) References Cited

U.S. PATENT DOCUMENTS

2010/0236927 A1* 9/2010 Pope ..... B01L 3/502792 204/600
2013/0220810 A1 8/2013 Wang
(Continued)

FOREIGN PATENT DOCUMENTS

WO WO-2015/031849 A1 3/2015

OTHER PUBLICATIONS

Chen et al., "Effects of gap height, applied frequency, and fluid conductivity on minimum actuation voltage of electrowetting-on-dielectric and liquid dielectrophoresis," Sensors and Actuators B: Chemical, 159(1):321-327 (2011).

*Primary Examiner* — Caitlyn Mingyun Sun
(74) *Attorney, Agent, or Firm* — Marshall, Gerstein & Borun LLP

(57) ABSTRACT

An electrowetting-based droplet actuator includes top and bottom substrates, a droplet-operation gap between the top and bottom substrates, the droplet-operation gap including a gradually-reduced gap height in a direction of droplet flow when in use, and spaced electrodes embedded in the bottom substrate spanning a region thereof corresponding to the gradually-reduced gap height. A method includes gradually reducing a gap height in section(s) of a droplet-operation gap between top and bottom substrates of an electrowetting-based droplet actuator, the gradually reducing being in a direction of droplet flow when in use from a large-gap inlet to a small-gap outlet (relative sizes), the large-gap inlet being larger in height, the bottom substrate including spaced electrodes embedded therein spanning a region of the bot-
(Continued)

tom substrate corresponding to the gradually reduced gap height, and moving dispensed droplet(s) of liquid in the direction of droplet flow using the spaced electrodes and an applied voltage.

18 Claims, 3 Drawing Sheets

(52) U.S. Cl.
CPC ..... *B01L 2300/0816* (2013.01); *B01L 2300/0851* (2013.01); *B01L 2400/0427* (2013.01)

(56) References Cited

U.S. PATENT DOCUMENTS

| | | | | |
|---|---|---|---|---|
| 2014/0161686 | A1 | 6/2014 | Bort et al. | |
| 2014/0216559 | A1 | 8/2014 | Foley | |
| 2015/0075991 | A1* | 3/2015 | Cyril | B01L 3/502723 204/600 |
| 2016/0175859 | A1* | 6/2016 | Yi | B05B 5/0255 239/690 |
| 2018/0095100 | A1* | 4/2018 | Nguyen | B01L 3/502715 |

* cited by examiner

DIGITAL FLUIDIC CARTRIDGE WITH INLET GAP HEIGHT LARGER THAN OUTLET GAP HEIGHT

CROSS-REFERENCE TO RELATED APPLICATIONS

This application is a 35 U.S.C. § 371 National Stage of International Patent Application No. PCT/US2018/060153, filed Nov. 9, 2018, which itself claims the benefit of and priority to U.S. Provisional Patent Application No. 62/585,726, filed Nov. 14, 2017, the content of each of which is incorporated by reference herein in its entirety and for all purposes.

BACKGROUND

A droplet actuator, which is one example of a digital fluidics cartridge, may include one or more substrates configured to form a surface or gap for conducting droplet operations. The one or more substrates establish a droplet operations surface or gap for conducting droplet operations and may also include electrodes arranged to conduct the droplet operations. The droplet operations substrate or the gap between the substrates may be coated or filled with a filler fluid that is immiscible with the liquid that forms the droplets. When large volumes of liquids (e.g., reagents) are used, for example, with a droplet actuator, dispensing and maintaining large volumes of liquids can be difficult. For example, in a droplet actuator, a typical on-actuator (or on-cartridge) reservoir for dispensing large volumes of reagents is elevated compared with the height of the droplet-operation gap. Consequently, reagents tend to flood uncontrolled from the on-actuator reservoir into the smaller droplet-operation gap. Further, a large volume on-actuator (or on-cartridge) reservoir requires a large area of the droplet actuator.

Therefore, there is a need for new approaches to managing large volumes of liquids in digital fluidic applications.

SUMMARY

The shortcomings of pre-existing approaches may be overcome and additional advantages are provided through the provision, in one aspect, of an apparatus. The apparatus comprises an electrowetting-based droplet actuator, including a top substrate, a bottom substrate below the top substrate, a droplet-operation gap between the top substrate and the bottom substrate, the droplet-operation gap comprising a gradually-reduced gap height in a direction of droplet flow when in use, and a plurality of spaced electrodes embedded in the bottom substrate spanning a region of the bottom substrate corresponding to the gradually-reduced gap height.

In accordance with another aspect, a method is provided. The method comprises gradually reducing a gap height of a droplet-operation gap between a top substrate and a bottom substrate of an electrowetting-based droplet actuator, the gradually reducing being in a direction of droplet flow when in use from a large-gap inlet to a small-gap outlet, the bottom substrate comprising a plurality of spaced electrodes embedded therein spanning a region of the bottom substrate corresponding to the gap height that is gradually reduced, and moving at least one droplet of liquid in the direction of droplet flow using the plurality of spaced electrodes.

In accordance with yet another aspect, a method is provided. The method comprises dispensing at least one droplet of liquid into a large-gap inlet of a droplet-operation gap of an electrowetting-based droplet actuator, the droplet-operation gap being situated between a top substrate and a bottom substrate of the electrowetting-based droplet actuator. The method further comprises moving the at least one droplet of liquid in a direction of droplet flow from the large-gap inlet along the bottom substrate using spaced electrodes embedded in the bottom substrate to a small-gap outlet of the droplet-operation gap, at least one section of the droplet-operation gap having a gradually-reduced gap height in the direction of droplet flow, the large-gap inlet having a gap height larger than a gap height of the small-gap outlet, and the gradually reducing comprises gradually reducing the gap height from about 20 microns to about 20 mm at the large-gap inlet to about 10 microns to about 2 mm at the small-gap outlet.

BRIEF DESCRIPTION OF THE DRAWINGS

These, and other objects, features and advantages of this application will become apparent from the following detailed description of the various aspects thereof taken in conjunction with the accompanying drawings, in which.

DETAILED DESCRIPTION

Figure 1:
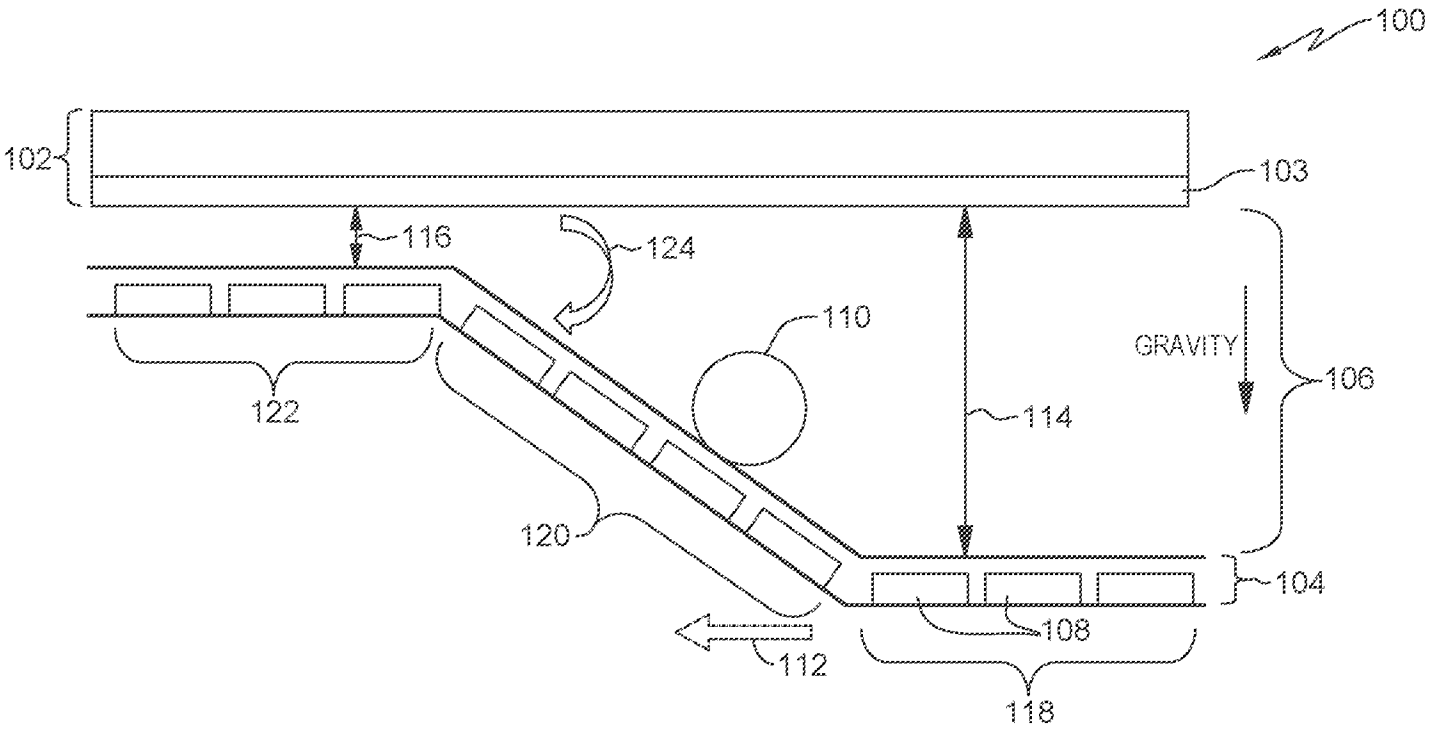
FIG. 1 depicts a side view of one example of an electrowetting-based droplet actuator with a bottom substrate including a ramp and a droplet of liquid being moved up the ramp via electrodes at a gradually-reduced gap height between the bottom substrate and a top substrate in a direction of droplet flow.

Aspects of the present application and certain features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the relevant details. It should be understood, however, that the detailed description and the specific examples, while indicating aspects of the application, are given by way of illustration only, and are not by way of limitation. Various substitutions, modifications, additions, and/or arrangements, within the spirit and/or scope of the underlying inventive concepts will be apparent to those skilled in the art from this application.

Approximating language, as used herein throughout the specification and claims, may be applied to modify any quantitative representation that could permissibly vary without resulting in a change in the basic function to which it is related. Accordingly, a value modified by a term or terms, such as "about" or "substantially," is not limited to the precise value specified. In some instances, the approximating language may correspond to the precision of an instrument for measuring the value.

The terminology used herein is for the purpose of describing particular examples only and is not intended to be limiting. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include (and any form of include, such as "includes" and "including"), and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more steps or elements. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

As used herein, the term "connected," when used to refer to two physical elements, means a direct connection between the two physical elements. The term "coupled," however, can mean a direct connection or a connection through one or more intermediary elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable or suitable. For example, in some circumstances, an event or capacity can be expected, while in other circumstances the event or capacity cannot occur—this distinction is captured by the terms "may" and "may be."

As used herein, unless otherwise specified, the approximating terms "about," "substantially" and the like, used with a value, such as measurement, size, etc., means a possible variation of plus or minus five percent of the value.

As used herein, the term "electrowetting-based droplet actuator" refers to a droplet actuator using electrowetting, which is the modification of the wetting properties of a surface (e.g., hydrophobic) with an applied voltage.

As used herein, the term "droplet-operation gap" refers to a space between top and bottom substrates of an electrowetting-based droplet actuator.

As used herein interchangeably, the terms "large-volume fluid(s)" and "large volume of fluid(s)" refer to a volume of fluid of greater than about 50 microliters to about 50 milliliters for a reservoir for an electrowetting-based droplet actuator.

As used herein, the term "abrupt," when used to describe an increase in a height of a droplet-operation gap refers to a removed portion of a top and/or bottom substrate of a droplet actuator creating sidewalls in the remaining top and/or bottom substrate having an angle of about 90 degrees with respect to the top and/or bottom substrate associated with the removed portion.

"Activate," with reference to one or more electrodes, means affecting a change in the electrical state of the one or more electrodes which, in the presence of a droplet, results in a droplet operation. Activation of an electrode can be accomplished using alternating current (AC) or direct current (DC). Any suitable voltage may be used which effects the desired operation, such as a droplet operation. For example, an electrode may be activated using a voltage which is greater than about 150 V, or greater than about 200 V, or greater than about 250 V, or from about 275 V to about 1000 V, or about 300 V. Where an AC signal is used, any suitable frequency may be employed which effects the desired operation, such as a droplet operation. For example, an electrode may be activated using an AC signal having a frequency from about 1 Hz to about 10 MHz, or from about 10 Hz to about 60 Hz, or from about 20 Hz to about 40 Hz, or about 30 Hz.

"Bead," with respect to beads on a droplet actuator, means any bead or particle that is capable of interacting with a droplet on or in proximity with a droplet actuator.

"Droplet" means a volume of liquid on a droplet actuator. In one example, a droplet is at least partially bounded by a filler fluid. For example, a droplet may be completely surrounded by a filler fluid or may be bounded by filler fluid and one or more surfaces of the droplet actuator. As another example, a droplet may be bounded by filler fluid, one or more surfaces of the droplet actuator, and/or the atmosphere. As yet another example, a droplet may be bounded by filler fluid and the atmosphere. Droplets may, for example, be aqueous or non-aqueous or may be mixtures or emulsions including aqueous and non-aqueous components. Droplets may take a wide variety of shapes; non-limiting examples include generally disc shaped, slug shaped, truncated sphere, ellipsoid, spherical, partially compressed sphere, hemispherical, ovoid, cylindrical, combinations of such shapes, and various shapes formed during droplet operations, such as merging or splitting or formed as a result of contact of such shapes with one or more surfaces of a droplet actuator. In various embodiments, a droplet may include a biological sample, such as whole blood, lymphatic fluid, serum, plasma, sweat, tear, saliva, sputum, cerebrospinal fluid, amniotic fluid, seminal fluid, vaginal excretion, serous fluid, synovial fluid, pericardial fluid, peritoneal fluid, pleural fluid, transudates, exudates, cystic fluid, bile, urine, gastric fluid, intestinal fluid, fecal samples, liquids containing single or multiple cells, liquids containing organelles, fluidized tissues, fluidized organisms, liquids containing multi-celled organisms, biological swabs and biological washes. Moreover, a droplet may include a reagent, such as water, deionized water, saline solutions, acidic solutions, basic solutions, detergent solutions and/or buffers. A droplet can include nucleic acids, such as DNA, genomic DNA, RNA, mRNA or analogs thereof; nucleotides such as deoxyribonucleotides, ribonucleotides or analogs thereof such as analogs having terminator moieties; enzymes such as polymerases, ligases, recombinases, or transposases; binding partners such as antibodies, epitopes, streptavidin, avidin, biotin, lectins or carbohydrates; or other biochemically active molecules. Other examples of droplet contents include reagents, such as a reagent for a biochemical protocol, such as a nucleic acid amplification protocol, an affinity-based assay protocol, an enzymatic assay protocol, a sequencing protocol, and/or a protocol for analyses of biological fluids. A droplet may include one or more beads.

"Droplet actuator" means a device for manipulating droplets. Certain droplet actuators will include one or more substrates arranged with a droplet-operation gap there between and electrodes associated with (e.g., layered on, attached to, and/or embedded in) the one or more substrates and arranged to conduct one or more droplet operations. For example, certain droplet actuators will include a base (or bottom) substrate, droplet operations electrodes associated with the substrate, one or more dielectric layers atop the substrate and/or electrodes, and optionally one or more hydrophobic layers atop the substrate, dielectric layers and/or the electrodes forming a droplet operations surface. A top substrate may also be provided, which is separated from the droplet operations surface by a gap, commonly referred to as a droplet-operation gap. Various electrode arrangements on the top and/or bottom substrates are discussed in the above-referenced patents and applications and certain novel electrode arrangements are discussed in the description of the present application. During droplet operations it may be desirable that droplets remain in continuous contact or frequent contact with a ground or reference electrode. A ground or reference electrode may be associated with the top substrate facing the gap, the bottom substrate facing the gap, in the gap. Where electrodes are provided on both substrates, electrical contacts for coupling the electrodes to a droplet actuator instrument for controlling or monitoring the electrodes may be associated with one or both plates. In some cases, electrodes on one substrate are electrically coupled to the other substrate so that only one substrate is in contact with the droplet actuator. In one embodiment, a conductive material (e.g., an epoxy, such as MASTER BOND™ Polymer System EP79, available from Master Bond, Inc., Hackensack, N.J.) provides the electrical connection between electrodes on one substrate and electrical paths on the other substrates, e.g., a ground electrode on a top substrate may be coupled to an electrical path on a bottom substrate by such a conductive material. Where multiple substrates are used, a spacer may be provided between the substrates to determine the height of the gap therebetween and define on-actuator dispensing reservoirs. The one or more openings may in some cases be aligned for interaction with one or more electrodes, e.g., aligned such that liquid flowed through the opening will come into sufficient proximity with one or more droplet operations electrodes to permit a droplet operation to be effected by the droplet operations electrodes using the liquid. The base (or bottom) and top substrates may in some cases be formed as one integral component. One or more reference electrodes may be provided on the base (or bottom) and/or top substrates and/or in the gap. In various embodiments, the manipulation of droplets by a droplet actuator may be electrode mediated, e.g., electrowetting mediated or dielectrophoresis mediated or Coulombic force mediated. Examples of techniques for controlling droplet operations that may be used in the droplet actuators of the present application include using devices that induce hydrodynamic fluidic pressure, such as those that operate on the basis of mechanical principles (e.g., external syringe pumps, pneumatic membrane pumps, vibrating membrane pumps, vacuum devices, centrifugal forces, piezoelectric/ultrasonic pumps and acoustic forces. Note that either a flowrate-control pumping device (e.g., a syringe pump) or pressure-control pumping device (e.g., a pressure controller) could be used. Further examples include electrical or magnetic principles (e.g., electroosmotic flow, electrokinetic pumps, ferrofluidic plugs, electrohydrodynamic pumps, attraction or repulsion using magnetic forces and magnetohydrodynamic pumps); thermodynamic principles (e.g., gas bubble generation/phase-change-induced volume expansion); other kinds of surface-wetting principles (e.g., electrowetting, and optoelectrowetting, as well as chemically, thermally, structurally and radioactively induced surface-tension gradients); gravity; surface tension (e.g., capillary action); electrostatic forces (e.g., electroosmotic flow); centrifugal flow (substrate disposed on a compact disc and rotated); magnetic forces (e.g., oscillating ions causes flow); magnetohydrodynamic forces; and vacuum or pressure differential. In certain embodiments, combinations of two or more of the foregoing techniques may be employed to conduct a droplet operation in a droplet actuator of the present application. Similarly, one or more of the foregoing may be used to deliver liquid into a droplet-operation gap, e.g., from a reservoir in another device or from an external reservoir of the droplet actuator (e.g., a reservoir associated with a droplet actuator substrate and a flow path from the reservoir into the droplet-operation gap). Droplet operations surfaces of certain droplet actuators of the present application may be made from hydrophobic materials or may be coated or treated to make them hydrophobic. For example, in some cases some portion or all of the droplet operations surfaces may be derivatized with low surface-energy materials or chemistries, e.g., by deposition or using in situ synthesis using compounds such as poly- or per-fluorinated compounds in solution or polymerizable monomers. In some cases, the droplet operations surface may include a hydrophobic coating. Moreover, in some embodiments, the top substrate of the droplet actuator includes an electrically conducting organic polymer, which is then coated with a hydrophobic coating or otherwise treated to make the droplet operations surface hydrophobic. For example, the electrically conducting organic polymer that is deposited onto a plastic substrate may be poly(3,4-ethylenedioxythiophene) poly(styrenesulfonate) (PEDOT:PSS). One or both substrates may be fabricated using, for example, a printed circuit board (PCB), glass, indium tin oxide (ITO)-coated glass, and/or semiconductor materials as the substrate.

"Droplet operation" means any manipulation of a droplet on a droplet actuator. A droplet operation may, for example, include: loading a droplet into the droplet actuator; dispensing one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The terms "merge," "merging," "combine," "combining" and the like are used to describe the creation of one droplet from two or more droplets. It should be understood that when such a term is used in reference to two or more droplets, any combination of droplet operations that are sufficient to result in the combination of the two or more droplets into one droplet may be used. For example, "merging droplet A with droplet B," can be achieved by transporting droplet A into contact with a stationary droplet B, transporting droplet B into contact with a stationary droplet A, or transporting droplets A and B into contact with each other. The terms "splitting," "separating" and "dividing" are not intended to imply any particular outcome with respect to volume of the resulting droplets (i.e., the volume of the resulting droplets can be the same or different) or number of resulting droplets (the number of resulting droplets may be 2, 3, 4, 5 or more). The term "mixing" refers to droplet operations which result in more homogenous distribution of one or more components within a droplet. Examples of "loading" droplet operations include microdialysis loading, pressure assisted loading, robotic loading, passive loading, and pipette loading. Droplet operations may be electrode-mediated. In some cases, droplet operations are further facilitated by the use of hydrophilic and/or hydrophobic regions on surfaces and/or by physical features, such as obstacles, gap height changes, or surface indentations. Impedance or capacitance sensing or imaging techniques may sometimes be used to determine or confirm the outcome of a droplet operation. Generally speaking, the sensing or imaging techniques may be used to confirm the presence or absence of a droplet at a specific electrode. For example, the presence of a dispensed droplet at the destination electrode following a droplet dispensing operation confirms that the droplet dispensing operation was effective. Similarly, the presence of a droplet at a detection spot at an appropriate step in an assay protocol may confirm that a previous set of droplet operations has successfully produced a droplet for detection. Droplet transport time can be quite fast. For example, in various embodiments, transport of a droplet from one electrode to the next may exceed about 1 sec, or about 0.1 sec, or about 0.01 sec, or about 0.001 sec. In one embodiment, the electrode is operated in AC mode but is switched to DC mode for imaging. It is sometimes helpful (though not an absolute requirement) for conducting droplet operations for the footprint area of droplet to be similar to electrowetting area; in other words, 1×-, 2×- 3×-droplets are usefully controlled operated using 1, 2, and 3 electrodes, respectively. If the droplet footprint is greater than number of electrodes available for conducting a droplet operation at a given time, the difference between the droplet size and the number of electrodes should, for example, not be greater than 1; in other words, a 2× droplet is usefully controlled using 1 electrode and a 3× droplet is usefully controlled using 2 electrodes. When droplets include beads, it is useful for droplet size to be equal to the number of electrodes controlling the droplet, e.g., transporting the droplet.

"Filler fluid" means a fluid associated with a droplet operations substrate of a droplet actuator, which fluid is sufficiently immiscible with a droplet phase to render the droplet phase subject to electrode-mediated droplet operations. For example, the droplet-operation gap of a droplet actuator may be, for example, filled with a filler fluid. The filler fluid may, for example, be or include a low-viscosity oil, such as silicone oil or hexadecane filler fluid. The filler fluid may be or include a halogenated oil, such as a fluorinated or perfluorinated oil. The filler fluid may fill the entire gap of the droplet actuator or may coat one or more surfaces of the droplet actuator. Filler fluids may be conductive or non-conductive. Filler fluids may be selected to improve droplet operations and/or reduce loss of reagent or target substances from droplets, improve formation of microdroplets, reduce cross contamination between droplets, reduce contamination of droplet actuator surfaces, reduce degradation of droplet actuator materials, etc. Fluorinated oils may in some cases be doped with fluorinated surfactants, e.g., Zonyl FSO-100 (Sigma-Aldrich) and/or others. A filler fluid may be, for example, a liquid. In some embodiments, a filler gas can be used instead of a liquid.

"Reservoir" means an enclosure or partial enclosure configured for holding, storing, and/or supplying liquid. A droplet actuator system of the present application may include on-cartridge reservoirs and/or off-cartridge reservoirs. On-cartridge reservoirs may, for example, include (1) on-actuator reservoirs, which are reservoirs in the droplet-operation gap or on the droplet operations surface; (2) off-actuator reservoirs, which are reservoirs on the droplet actuator cartridge, but outside the droplet-operation gap, and not in contact with the droplet operations surface; or (3) hybrid reservoirs which have on-actuator regions and off-actuator regions. An example of an off-actuator reservoir is a reservoir in the top substrate. An off-actuator reservoir may be, for example, in fluid communication with an opening or flow path arranged for flowing liquid from the off-actuator reservoir into the droplet-operation gap, such as into an on-actuator reservoir. An off-cartridge reservoir may be a reservoir that is not part of the droplet actuator cartridge at all, but which flows liquid to some portion of the droplet actuator cartridge. For example, an off-cartridge reservoir may be part of a system or docking station to which the droplet actuator cartridge is coupled during operation. Similarly, an off-cartridge reservoir may be a reagent storage container or syringe which is used to force fluid into an on-cartridge reservoir or into a droplet-operation gap. A system using an off-cartridge reservoir will typically include a fluid passage means whereby liquid may be transferred from the off-cartridge reservoir into an on-cartridge reservoir or into a droplet-operation gap.

As used herein with respect to a configuration for an electrowetting-based droplet actuator, the term "biplanar configuration" means the presence of an electrode(s) in both the top and bottom substrates. When in use, there is a potential difference between the top and bottom electrodes.

As used herein with respect to a configuration for an electrowetting-based droplet actuator, the term "coplanar configuration" means an absence of electrodes in the top substrate. In use, there is a potential difference between electrodes on the bottom substrate or between electrodes of the bottom substrate and another electrode (e.g., a copper wire) situated above the bottom substrate.

The terms "top," "bottom," "over," "under," and "on" are used throughout the description with reference to the relative positions of components of the droplet actuator, such as relative positions of top and bottom substrates of the droplet actuator. It will be appreciated that the droplet actuator is functional regardless of its orientation in space.

When a liquid in any form (e.g., a droplet or a continuous body, whether moving or stationary) is described as being "on", "at", or "over" an electrode, array, matrix or surface, such liquid could be either in direct contact with the electrode/array/matrix/surface, or could be in contact with one or more layers or films that are interposed between the liquid and the electrode/array/matrix/surface. In one example, filler fluid can be considered as a film between such liquid and the electrode/array/matrix/surface.

When a droplet is described as being "on" or "loaded on" a droplet actuator, it should be understood that the droplet is arranged on the droplet actuator in a manner which facilitates using the droplet actuator to conduct one or more droplet operations on the droplet, the droplet is arranged on the droplet actuator in a manner which facilitates sensing of a property of or a signal from the droplet, and/or the droplet has been subjected to a droplet operation on the droplet actuator.

The terms "fluidics cartridge," "digital fluidics cartridge," "droplet actuator," and "droplet actuator cartridge" as used throughout the description can be synonymous.

Digital microfluidic technology is based on the use of "electrowetting" to precisely manipulate droplets of fluid on a surface. The term "electrowetting" describes the ability of an applied voltage to modulate the "wettability" of a surface. Aqueous droplets naturally "bead-up" on a hydrophobic surface but a voltage applied between a droplet and an insulated electrode can cause the droplet to spread on the surface. Digital microfluidics harnesses the electrowetting effect to precisely manipulate droplets within a sealed microfluidic cartridge (also called a "Lab-on-a-chip"). Electrical signals are applied to an array of electrodes to control the size and position of each droplet. Droplets are transferred between adjacent electrodes by removing voltage from one electrode and applying it to the next one. The same processes can be used to dispense, merge or split droplets using electrical signals. Fully-programmable fluid handling is thereby achieved without the use of any pumps, valves or channels.

Reference is made below to the drawings, which are not drawn to scale for ease of understanding, wherein the same reference numbers are used throughout different figures to designate the same or similar components.

The present application relates to electrowetting-based droplet actuators with an inlet gap height larger than an outlet gap height.

FIG. 1 is a side view of one example of an electrowetting-based droplet actuator 100. The electrowetting-based droplet actuator includes a top substrate 102 and a bottom substrate 104 spaced apart from the top substrate by a droplet-operation gap 106. There can be no electrodes, one electrode or multiple electrodes associated with the top substrate, depending on whether a biplanar or coplanar configuration is used. In one example shown in FIG. 1, one electrode 103 is associated with the top substrate, which may be planar. The bottom substrate has a series of spaced electrodes 108 embedded throughout, including ramp 120, for manipulating droplets of fluid, for example, moving droplet 110 along the bottom substrate in a direction of droplet flow 112 from a large-gap inlet 114 to a small-gap outlet 116 in the droplet-operation gap. The bottom substrate includes three sections in this example: a planar inlet section 118; a ramped middle section 120; and a planar outlet section 122. The ramped middle section has a gradually reduced height for the droplet-operation gap and is angled 124 with respect to the top substrate.

Some benefits of the electrowetting-based droplet actuator 100 of FIG. 1 include, for example, that the inlet/outlet size difference reduces or eliminates the risk of liquid flooding into the outlet, the large-gap inlet can handle a larger volume of fluid as compared to the inlet and outlet being a same gap height and the negative influence of gravity on dispensing can be reduced or eliminated using the ramped design. In addition, droplets at the inlet need not touch the top substrate.

Top 102 and bottom 104 substrates can comprise materials that are, for example, flexible, rigid or a hybrid of flexible and rigid. In one example, the substrates can be an injection molded part (rigid) with printed electrodes. Examples of flexible substrates include printed circuit boards, an elastomer, a polyethylene terephthalate film or even paper. In one example, the substrates may include a non-stick coating. In the biplanar configuration, there is a potential difference between the top and bottom electrodes. For example, a positive voltage can be applied to the electrodes 108 of the bottom substrate, while the top electrode 103 is grounded. In the coplanar configuration, the potential difference occurs on the bottom substrate. In one coplanar embodiment, the potential difference occurs between electrodes in the bottom substrate, 104. In another coplanar embodiment, the potential difference between the electrodes in the bottom substrate and another electrode (for example copper wire) lying above the bottom substrate (104). Both the coplanar and the biplanar configurations can be used. A gap height of the large-gap inlet 114 of the electrowetting-based droplet actuator 100 is necessarily always larger than the gap height of the small-gap outlet. In one example, the gap height of the large-gap inlet may be, for example, about 20 microns to about 20 mm, and the gap height of the small-gap outlet may be, for example, about 10 microns to about 2 mm. In one example, the ramp(s) span less than the length of the bottom substrate, such that a stable gap height exists at the inlet and outlet. However, the ramp(s) could begin at the inlet and/or terminate at the outlet. In any case, where two or more ramps are present, a horizontal span of the bottom substrate may join adjacent ramps. The angle 124 of the ramp is non-zero and less than 90 degrees. As will be appreciated, more than one ramp may be included, which may or may not have the same angle with regard to the top substrate. In light of the gap height of the large-gap inlet, larger droplets can be dispensed as compared to the no gap height difference with the outlet. In one example, more than one of the bottom electrodes can be used in tandem to better manipulate a large droplet. In another example, the electrodes of the bottom substrate may be evenly spaced along each ramp, or may be evenly spaced throughout the length of the bottom substrate.

Figure 2:
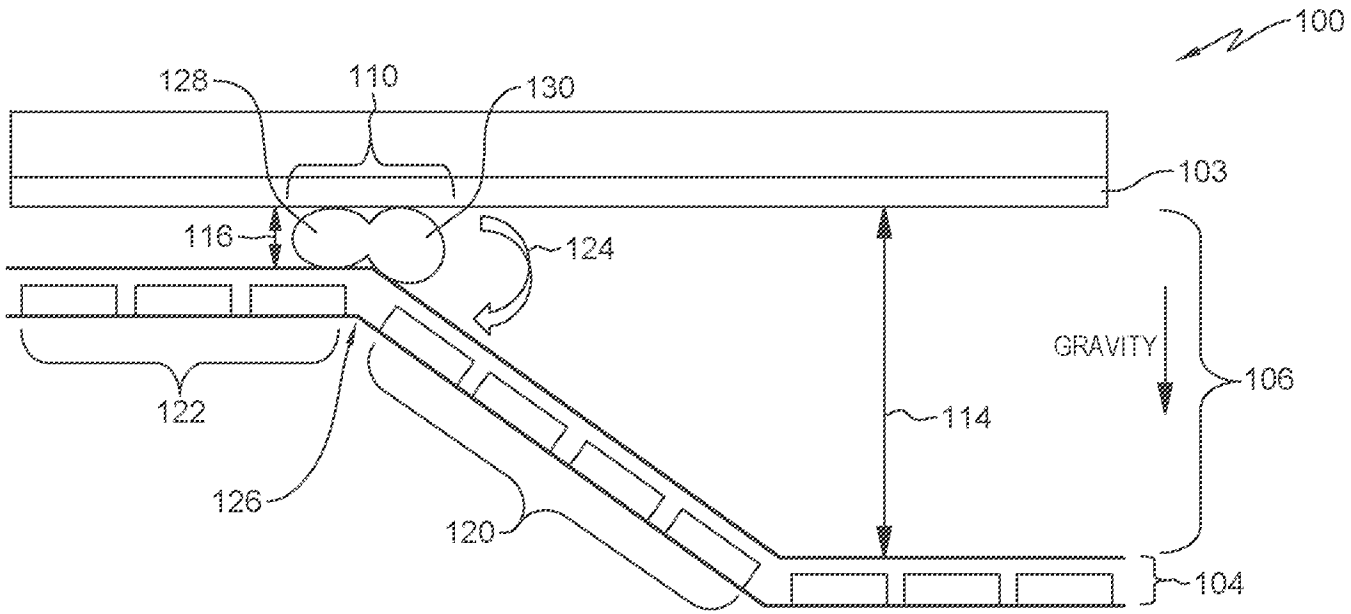
FIG. 2 depicts one example of the electrowetting-based droplet actuator of FIG. 1 showing the droplet reaching a top of the ramp and being split into two droplets.

FIG. 2 depicts one example of the electrowetting-based droplet actuator of FIG. 1 when droplet 110 reaches an intersection 126 of the ramped middle section 120 and planar outlet section 122 of the bottom substrate 104. Due to the gap height difference between the two sections, droplet 110 is split into two droplets 128 and 130. Droplet splitting is one example of a droplet operation.

Figure 3:
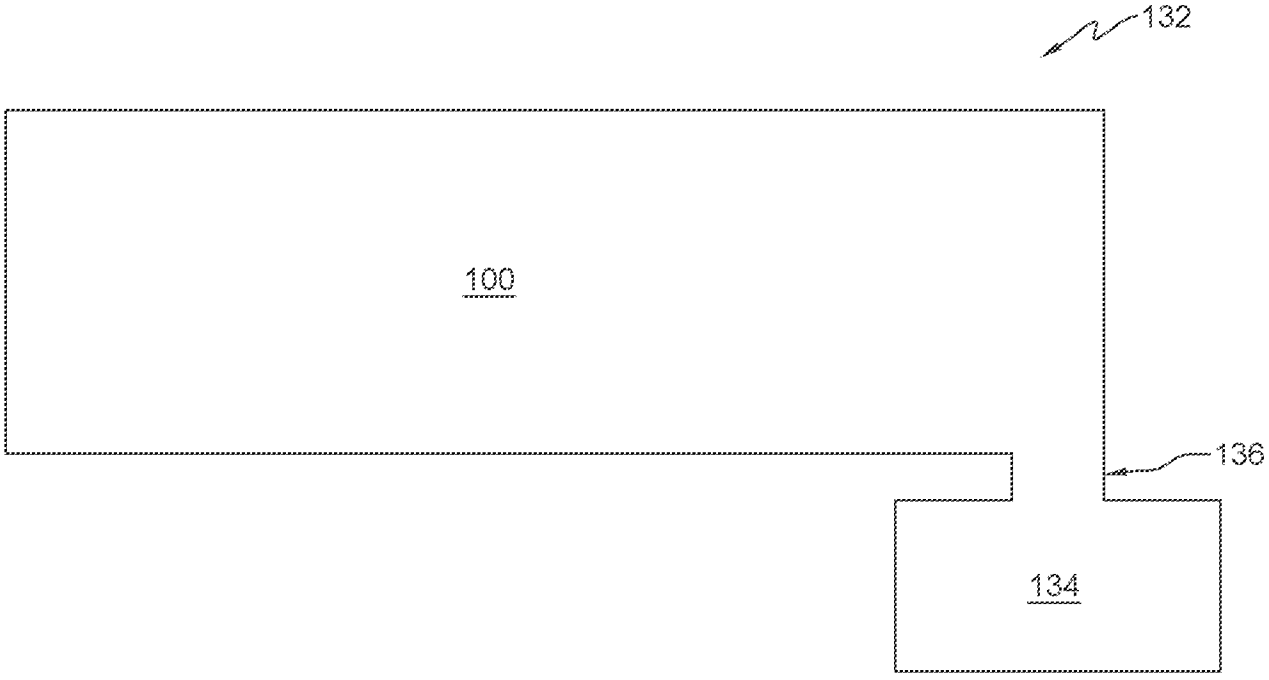
FIG. 3 depicts one example of the electrowetting-based droplet actuator of FIG. 1 (without the droplet) with a large-volume reservoir coupled to a bottom of the electrowetting-based droplet actuator.

FIG. 3 is a block diagram 132 of one example of the electrowetting-based droplet actuator 100 of FIGS. 1 and 2 being coupled at a bottom surface (or "bottom-coupled") to a reservoir 134 external to the electrowetting-based droplet actuator via, for example, conduit 136.

In a first aspect, disclosed above is an apparatus. The apparatus includes an electrowetting-based droplet actuator, including a top substrate and a bottom substrate below the top substrate. The electrowetting-based droplet actuator further includes a droplet-operation gap between the top substrate and the bottom substrate, the droplet-operation gap including a gradually-reduced gap height in a direction of droplet flow when in use, and spaced electrodes embedded in the bottom substrate spanning a region of the bottom substrate corresponding to the gradually-reduced gap height.

In one example, the bottom substrate may include, for example, at least one ramp, the at least one ramp achieving the gradually-reduced gap height. In one example, the at least one ramp may include, for example, a first end and a second end opposite the first end, and the at least one ramp being coupled at the first end to a large-gap inlet and being coupled at the second end to a small-gap outlet, the large-gap inlet having a gap height larger than a gap height of the small-gap outlet. In one example, the gap height of the large-gap inlet may be, for example, about 20 microns to about 20 mm, the gap height of the small-gap inlet being about 10 microns to about 2 mm, and the height of the large-gap inlet being larger than the height of the small-gap outlet.

In one example, the at least one ramp may form, for example, an angle with respect to the top substrate of more than zero degrees and less than 90 degrees.

In one example, the at least one ramp may span, for example, a portion, but less than all, of the bottom substrate. In one example, an inlet portion of the bottom substrate may be, for example, planar and coupled to the at least one ramp.

In one example, an outlet portion of the bottom substrate may be, for example, planar and coupled to the at least one ramp.

In one example, the spaced electrodes may be, for example, evenly spaced along the at least one ramp.

In one example, the electrowetting-based droplet actuator may have, for example, a biplanar configuration.

In one example, the electrowetting-based droplet actuator may have, for example, a coplanar configuration.

In one example, the electrowetting-based droplet actuator of the apparatus of the first aspect may be, for example, part of a system, the system may further include, for example, a reservoir bottom-coupled and external to the electrowetting-based droplet actuator. In one example, the reservoir of the system may include, for example, a large-volume reservoir.

In a second aspect, disclosed above is a method. The method includes gradually reducing a gap height of a droplet-operation gap between a top substrate and a bottom substrate of an electrowetting-based droplet actuator, the gradually reducing being in a direction of droplet flow when in use from a large-gap inlet to a small-gap outlet, the bottom substrate includes spaced electrodes embedded therein spanning a region of the bottom substrate corresponding to the gap height that is gradually reduced, and moving droplet(s) of liquid in the direction of droplet flow using the spaced electrodes.

In one example, the gradually reducing may include, for example, ramping at least a portion of the bottom substrate with ramp(s). In one example, the spaced electrodes may span, for example, an entirety of the ramp(s), and the moving may include, for example, moving the droplet(s) up the ramp(s).

In one example, the method may further include, for example, situating the ramp(s) at an angle relative to the top substrate of more than zero degrees and less than 90 degrees.

In one example, the method of the second aspect may further include, for example, feeding the liquid to the large-gap inlet from a large-volume reservoir coupled to a bottom of the electrowetting-based droplet actuator.

In one example, the method of the second aspect may further include, for example, splitting the droplet (s) at the small-gap outlet.

In a third aspect, disclosed above is a method. The method includes dispensing droplet(s) of liquid into a large-gap inlet of a droplet-operation gap of an electrowetting-based droplet actuator, the droplet-operation gap being situated between a top substrate and a bottom substrate of the electrowetting-based droplet actuator. The method further includes moving the at droplet(s) of liquid in a direction of droplet flow from the large-gap inlet along the bottom substrate using a plurality of spaced electrodes embedded in the bottom substrate to a small-gap outlet of the droplet-operation gap, section(s) of the droplet-operation gap having a gradually-reduced gap height in the direction of droplet flow, the large-gap inlet having a gap height larger than a gap height of the small-gap outlet, and the gradually reducing including gradually reducing the gap height from about 20 microns to about 20 mm at the large-gap inlet to about 10 microns to about 2 mm at the small-gap outlet.

While several aspects of the present application have been described and depicted herein, alternative aspects may be effected by those skilled in the art to accomplish the same objectives. Accordingly, it is intended by the appended claims to cover all such alternative aspects.

It should be appreciated that all combinations of the foregoing concepts (provided such concepts are not mutually inconsistent) are contemplated as being part of the inventive subject matter disclosed herein. In particular, all combinations of claimed subject matter appearing at the end of this application are contemplated as being part of the inventive subject matter disclosed herein.

The invention claimed is:

1. An apparatus, comprising:

an electrowetting-based droplet actuator, comprising:

a substantially planar top substrate;

a bottom substrate below the top substrate and comprising an inlet section, a ramp having a substantially constant thickness, and an outlet section;

a droplet-operation gap between the top substrate and the bottom substrate, wherein the droplet-operation gap comprises a gradually-reduced gap height in a direction of droplet flow when in use and wherein the ramp provides the gradually-reduced gap height; and a plurality of spaced electrodes embedded in the ramp of the bottom substrate spanning a region of the bottom substrate corresponding to the gradually-reduced gap height, the plurality of electrodes comprising a first electrode and a second electrode, the first electrode being spaced a first distance from the top substrate and the second electrode being spaced a second distance from the top substrate, the first distance being less than the second distance.

2. The apparatus of claim 1, wherein the ramp comprises a first end and a second end opposite the first end, and wherein the ramp is coupled at the first end to a large-gap inlet and is coupled at the second end to a small-gap outlet, the large-gap inlet having a gap height larger than a gap height of the small-gap outlet.

3. The apparatus of claim 2, wherein the gap height of the large-gap inlet is about 20 microns to about 20 mm, wherein the gap height of the small-gap outlet is about 10 microns to about 2 mm, and wherein the height of the large-gap inlet is larger than the height of the small-gap outlet.

4. The apparatus of claim 2, wherein the ramp forms an angle with respect to the top substrate of more than zero degrees and less than 90 degrees.

5. The apparatus of claim 1, wherein the ramp spans a portion, but less than all, of the bottom substrate.

6. The apparatus of claim 5, wherein the inlet section of the bottom substrate is planar and coupled to the ramp.

7. The apparatus of claim 5, wherein the outlet section of the bottom substrate is planar and coupled to the ramp.

8. The apparatus of claim 1, wherein the plurality of spaced electrodes are evenly spaced along the ramp.

9. The apparatus of claim 1, wherein the electrowetting-based droplet actuator has a biplanar configuration.

10. The apparatus of claim 1, wherein the electrowetting-based droplet actuator has a coplanar configuration.

11. The apparatus of claim 1, wherein the electrowetting-based droplet actuator is part of a system, the system further comprising a reservoir bottom-coupled and external to the electrowetting-based droplet actuator.

12. An apparatus, comprising:

an electrowetting-based droplet actuator, comprising:

a substantially planar top substrate;

a bottom substrate below the top substrate, the top substrate and the bottom substrate defining a droplet-operation gap that has a gradually reduced height; and a plurality of spaced electrodes embedded in the bottom substrate, the plurality of electrodes comprising a first electrode and a second electrode, the first electrode being spaced a first distance from the top substrate and the second electrode being spaced a second distance from the top substrate, the first distance being less than the second distance, wherein the bottom substrate comprises an inlet section, a middle section, and an outlet section, the first electrode and the second electrode being embedded in the middle section, and the middle section comprises a ramped middle section having a substantially constant thickness.

13. The apparatus of claim 12, wherein the first electrode has a face, the second electrode has a face, and the middle section of the bottom substrate has a surface defining the droplet-operation gap, the face of the first electrode and the face of the second electrode being substantially parallel to the surface of the bottom substrate.

14. The apparatus of claim 12, wherein the plurality of electrodes further comprises a third electrode and a fourth electrode, the third electrode being embedded in the inlet section and the fourth electrode being embedded in the outlet section.

15. The apparatus of claim 12, the first electrode and the second electrode being embedded in the ramped middle section.

16. The apparatus of claim 15, wherein the droplet-operation gap comprises an inlet and an outlet.

17. The apparatus of claim 16, wherein the ramped middle section begins at the inlet.

18. The apparatus of claim 16, wherein the ramped middle section terminates at the outlet.

* * * * *